US006289591B1

(12) United States Patent
Rodriguez

(10) Patent No.: US 6,289,591 B1
(45) Date of Patent: Sep. 18, 2001

(54) CHEESE STORAGE AND CUTTING SYSTEM

(76) Inventor: Mike R. Rodriguez, 11410 Cedar Park, San Antonio, TX (US) 78249

( * ) Notice: Subject to any disclaimer, the term of this patent is extended or adjusted under 35 U.S.C. 154(b) by 0 days.

(21) Appl. No.: 09/519,758

(22) Filed: Mar. 6, 2000

(51) Int. Cl.[7] ..... B26B 11/00

(52) U.S. Cl. ..... 30/124; 30/115; 30/116; 30/280; 206/551

(58) Field of Search ..... 30/123, 124, 115, 30/116, 279.6, 278, 280; 269/291; 206/551; D7/609, 629, 610, 703

(56) References Cited

U.S. PATENT DOCUMENTS

| | | | | |
|---|---|---|---|---|
| D. 282,809 | | 3/1986 | Daenen et al. . | |
| D. 391,809 | * | 3/1998 | Jeppesen et al. | D7/629 |
| D. 419,033 | * | 1/2000 | Thomas | D7/609 |
| 1,679,004 | * | 7/1928 | Pinkel et al. | 30/116 |
| 1,798,551 | | 3/1931 | Mocking et al. . | |
| 2,538,426 | * | 1/1951 | Olander | 30/116 |
| 2,716,814 | | 9/1955 | Lerner . | |
| 2,783,538 | * | 3/1957 | Spevak | 30/116 |
| 2,813,336 | | 11/1957 | Ackerman . | |
| 2,829,434 | * | 4/1958 | Schweikert | 30/280 |
| 4,513,501 | | 4/1985 | Lee . | |
| 4,756,083 | | 7/1988 | Alonso . | |

* cited by examiner

*Primary Examiner*—Hwei-Siu Payer

(57) ABSTRACT

A cheese storage and cutting system for storing cheese such that the amount of cheese remaining is visible. The cheese storage and cutting system includes a base portion having a peripheral edge. A lip extends upwardly from the base portion. A platform for resting cheese on has a shape substantially similar to the base portion. The platform has a plurality of bores therein. A cover portion covers the base portion and the platform. The cover portion has a top wall and a peripheral wall. The peripheral wall has a free peripheral edge that has a shape and size adapted to fit between the lip and the peripheral edge of the base portion.

16 Claims, 2 Drawing Sheets

CHEESE STORAGE AND CUTTING SYSTEM

BACKGROUND OF THE INVENTION

1. Field of the Invention

The present invention relates to storage devices and more particularly pertains to a new cheese storage and cutting system for storing cheese such that the amount of cheese remaining is visible.

2. Description of the Prior Art

The use of storage devices is known in the prior art. More specifically, storage devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,798,551; U.S. Pat. No. 4,513,501; U.S. Pat. No. 4,756,083; U.S. Pat. No. 2,813,336; U.S. Pat. No. 2,716,814; and U.S. Des. Pat. No. 282,809.

While these devices fulfill their respective, particular objectives and requirements, the aforementioned patents do not disclose a new cheese storage and cutting system. The inventive device includes a base portion having a peripheral edge. A lip extends upwardly from the base portion. A platform for resting cheese on has a shape substantially similar to the base portion. The platform has a plurality of bores therein. A cover portion covers the base portion and the platform. The cover portion has a top wall and a peripheral wall. The peripheral wall has a free peripheral edge that has a shape and size adapted to fit between the lip and the peripheral edge of the base portion.

In these respects, the cheese storage and cutting system according to the present invention substantially departs from the conventional concepts and designs of the prior art, and in so doing provides an apparatus primarily developed for the purpose of storing cheese such that the amount of cheese remaining is visible.

SUMMARY OF THE INVENTION

In view of the foregoing disadvantages inherent in the known types of storage devices now present in the prior art, the present invention provides a new cheese storage and cutting system construction wherein the same can be utilized for storing cheese such that the amount of cheese remaining is visible.

The general purpose of the present invention, which will be described subsequently in greater detail, is to provide a new cheese storage and cutting system apparatus and method which has many of the advantages of the storage devices mentioned heretofore and many novel features that result in a new cheese storage and cutting system which is not anticipated, rendered obvious, suggested, or even implied by any of the prior art storage devices, either alone or in any combination thereof.

To attain this, the present invention generally comprises a base portion having a peripheral edge. A lip extends upwardly from the base portion. A platform for resting cheese on has a shape substantially similar to the base portion. The platform has a plurality of bores therein. A cover portion covers the base portion and the platform. The cover portion has a top wall and a peripheral wall. The peripheral wall has a free peripheral edge that has a shape and size adapted to fit between the lip and the peripheral edge of the base portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cheese storage and cutting system apparatus and method which has many of the advantages of the storage devices mentioned heretofore and many novel features that result in a new cheese storage and cutting system which is not anticipated, rendered obvious, suggested, or even implied by any of the prior art storage devices, either alone or in any combination thereof.

It is another object of the present invention to provide a new cheese storage and cutting system which may be easily and efficiently manufactured and marketed.

It is a further object of the present invention to provide a new cheese storage and cutting system which is of a durable and reliable construction.

An even further object of the present invention is to provide a new cheese storage and cutting system which is susceptible of a low cost of manufacture with regard to both materials and labor, and which accordingly is then susceptible of low prices of sale to the consuming public, thereby making such cheese storage and cutting system economically available to the buying public.

Still yet another object of the present invention is to provide a new cheese storage and cutting system which provides in the apparatuses and methods of the prior art some of the advantages thereof, while simultaneously overcoming some of the disadvantages normally associated therewith.

Still another object of the present invention is to provide a new cheese storage and cutting system for storing cheese such that the amount of cheese remaining is visible.

Yet another object of the present invention is to provide a new cheese storage and cutting system which includes a base portion having a peripheral edge. A lip extends upwardly from the base portion. A platform for resting cheese on has a shape substantially similar to the base portion. The platform has a plurality of bores therein. A cover portion covers the base portion and the platform. The cover portion has a top wall and a peripheral wall. The peripheral wall has a free peripheral edge that has a shape and size adapted to fit between the lip and the peripheral edge of the base portion.

Still yet another object of the present invention is to provide a new cheese storage and cutting system that allows a consumer to remove cheese from its packaging and place it in container which is more conducive to cutting the cheese.

Even still another object of the present invention is to provide a new cheese storage and cutting system that contains a platform which allows the user to cut the cheese on the device without having to place the cheese on another surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
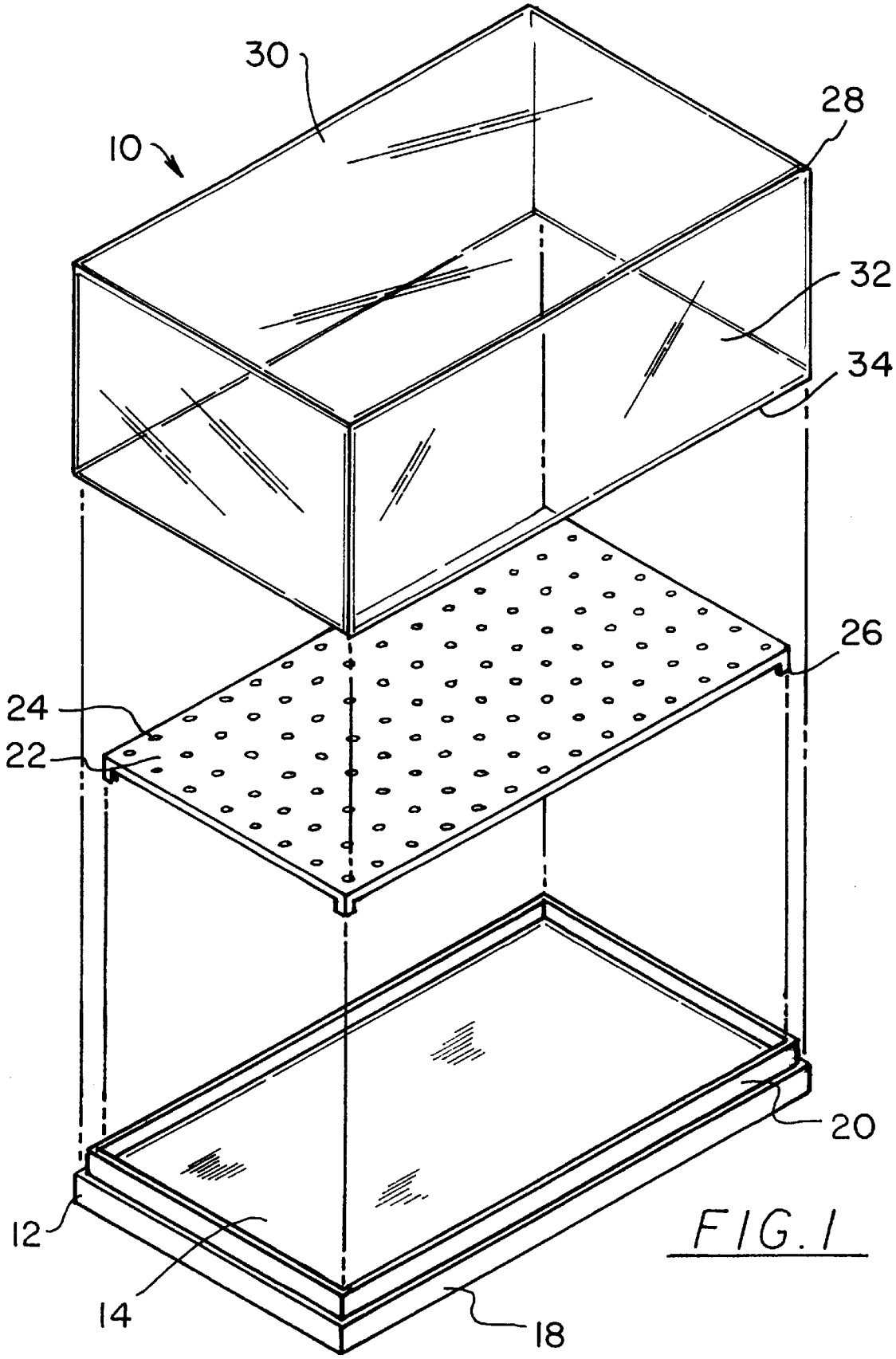
FIG. 1 is a schematic perspective view of a new cheese storage and cutting system according to the present invention.
Figure 2:
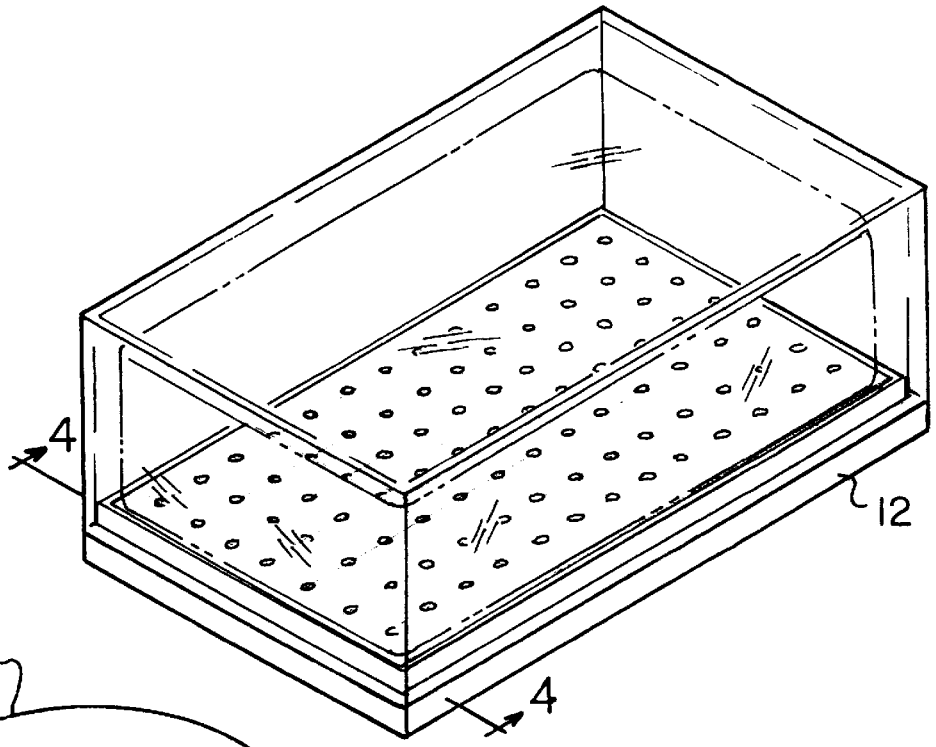
FIG. 2 is a schematic perspective view of the present invention.
Figure 3:
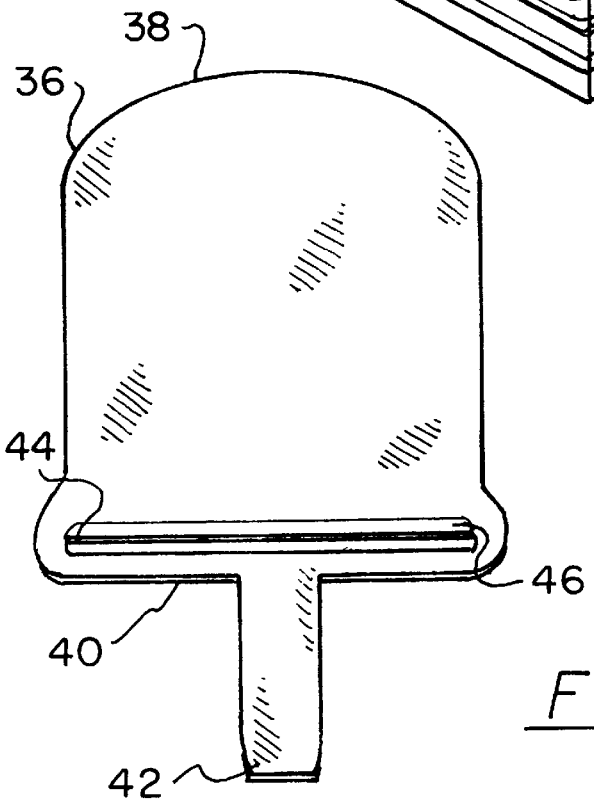
FIG. 3 is a schematic plan view of a cutting means of the present invention.
Figure 4:
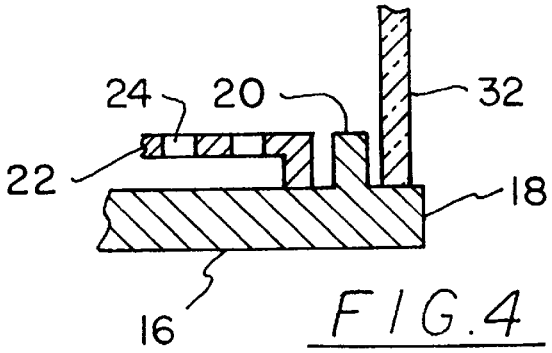
FIG. 4 is a schematic cross-sectional view taken along line 4—4 of the present invention.

With reference now to the drawings, and in particular to FIGS. 1 through 4 thereof, a new cheese storage and cutting system embodying the principles and concepts of the present invention and generally designated by the reference numeral 10 will be described.

As best illustrated in FIGS. 1 through 4, the cheese storage and cutting system 10 generally comprises a base portion 12 has a top surface 14, a bottom surface 16 and a peripheral edge 18. A lip 20 extends upwardly from the top surface 14. The lip 20 is generally adjacent to the peripheral edge 18. The bottom surface 16 has a generally rectangular shape.

A platform 22 for resting the cheese on has a shape substantially similar to the base portion 12. The platform 22 has a plurality of bores 24 therein. The bores 24 allow liquid to drain away from the cheese. The platform 22 has a plurality of legs 26 thereon. The platform 22 has a generally rectangular shape such that each of the legs 26 is generally adjacent to a corner of the platform 22.

A cover portion 28 covers the base portion 12 and the platform 22. The cover portion 28 has a top wall 30 and a peripheral wall 32. The peripheral wall 32 has a free peripheral edge 34. The free peripheral edge 34 has a shape and size adapted to fit between the lip 20 and the peripheral edge 18 of the base portion 12. The top wall 30 has a generally rectangular shape. Ideally, the cover portion 28 is transparent and is made from a plastic. Preferably, the cover portion has an interior area of less than one thousand cubic inches.

A slicing means 36 slices the cheese. The slicing means 36 is generally planar and has a distal end 38 and a proximal end 40. The proximal end 40 has an elongate member 42 extending therefrom and defining a handle. The slicing means 36 has a slot 44 therein. The slot 44 is elongate and is located generally adjacent to the proximal end 40. The slot 44 has a blade 46 therein. The blade 46 has a cutting edge which is outside of a plane of the slicing means 36. The slicing means 36 is moved across the cheese and a portion of the cheese is cut by the blade 46, which causes the portion of the cheese to be expelled through the slot 44 in the slicing means 36.

In use, cheese is placed on the platform 22 and the cover 28 is placed over the cheese. The cover 28 is preferably transparent so that the user can see the amount of cheese remaining. When a slice of cheese is needed, the user removes the cover 28 and runs the slicing means 36 across the top of the cheese.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cheese storage device, said device comprising:

a base portion, said base portion having a peripheral edge, said base portion having a lip extending upwardly therefrom;

a platform for resting cheese on, said platform having a shape substantially similar to said base portion, said platform having a plurality of bores therein; and a cover portion for covering said base portion and said platform, said cover portion having a top wall and a peripheral wall, said peripheral wall having a free peripheral edge, said free peripheral edge having a shape and size adapted to fit between said lip and said peripheral edge of said base portion.

2. The cheese storage device as in claim 1, said base portion further comprising:

said base portion having a top surface, and a bottom surface, wherein said lip extends upwardly from said top surface, said lip being generally adjacent to said peripheral edge, said bottom surface having a generally rectangular shape.

3. The cheese storage device as in claim 2, wherein said platform comprises:

said platform having a plurality of legs thereon, said platform having a generally rectangular shape, each of said legs being generally adjacent to a corner of said platform.

4. The cheese storage device as in claim 3, wherein said cover portion comprises:

said top wall having a generally rectangular shape, said cover portion being transparent, said cover portion being made from a plastic.

5. The cheese storage device as in claim 4, further comprising:

a slicing means for slicing the cheese, said slicing means being generally planar, said slicing means having a distal end and a proximal end, said proximal end having an elongate member extending therefrom and defining a handle, said slicing means having a slot therein, said slot being elongate and being located generally adjacent to said proximal end, said slot having a blade therein, said blade having a cutting edge, said cutting edge being outside of a plane of said slicing means, wherein said slicing means is moved across the cheese and a portion of the cheese is cut by the blade, wherein the portion of the cheese is expelled through the slot in said slicing means.

6. A cheese storage and cutting system, said system comprising:

a base portion, said base portion having a top surface, a bottom surface and a peripheral edge, a lip extending upward from said top surface, said lip being generally adjacent to said peripheral edge, said bottom surface having a generally rectangular shape;

a platform for resting cheese on, said platform having a shape substantially similar to said base portion, said platform having a plurality of bores therein, said platform having a plurality of legs thereon, said platform having a generally rectangular shape, each of said legs being generally adjacent to a corner of said platform;

a cover portion for covering said base portion and said platform, said cover portion having a top wall and a peripheral wall, said peripheral wall having a free peripheral edge, said free peripheral edge having a shape and size adapted to fit between said lip and said peripheral edge of said base portion, said top wall having a generally rectangular shape, said cover portion being transparent, said cover portion being made from a plastic; and a slicing means for slicing the cheese, said slicing means being generally planar, said slicing means having a distal end and a proximal end, said proximal end having an elongate member extending therefrom and defining a handle, said slicing means having a slot therein, said slot being elongate and being located generally adjacent to said proximal end, said slot having a blade therein, said blade having a cutting edge, said cutting edge being outside of a plane of said slicing means, wherein said slicing means is moved across the cheese and a portion of the cheese is cut by the blade, wherein the portion of the cheese is expelled through the slot in said slicing means.

7. A cheese storage device comprising:

a base portion having a top surface and a peripheral edge;

a platform, at least one leg mounted on said platform for supporting said platform in an elevated condition above the top surface of said base portion, said platform having a plurality of bores therethrough; and a cover portion removably mountable on said base portion for enclosing said platform between said cover portion and said base portion.

8. The device of claim 7 wherein said platform has an upper surface and a lower surface, the plurality of bores extending between the upper and lower surfaces of said platform.

9. The device of claim 7 wherein said base portion has a lip extending upwardly from the top surface of said base portion.

10. The device of claim 9 wherein said cover portion has a top wall and a peripheral wall, said peripheral wall having a free peripheral edge, said free peripheral edge having a shape and size adapted to fit between said lip and said peripheral edge of said base portion.

11. The device of claim 9 wherein said base portion has a bottom surface, wherein said lip extends upwardly from said top surface, said lip being generally adjacent to said peripheral edge, said bottom surface having a generally rectangular shape.

12. The device of claim 7 wherein said platform has a generally rectangular shape.

13. The device of claim 7 wherein a plurality of said legs are mounted on said platform, each of said legs being positioned generally adjacent to a corner of said platform.

14. The device of claim 7 wherein said cover portion has a generally rectangular shape.

15. The device of claim 7 further comprising a slicing means for slicing cheese.

16. The device of claim 15 wherein said slicing means being generally planar, said slicing means having a distal end and a proximal end, said proximal end having an elongate member extending therefrom and defining a handle, said slicing means having a slot therein, said slot being elongate and being located generally adjacent to said proximal end, said slot having a blade therein, said blade having a cutting edge, said cutting edge being outside of a plane of said slicing means, wherein said slicing means is moved across the cheese and a portion of the cheese is cut by the blade, wherein the portion of the cheese is expelled through the slot in said slicing means.

* * * * *